United States Patent [19]

Kramer

[11] Patent Number: 5,012,826

[45] Date of Patent: May 7, 1991

[54] METHOD OF EXPANDING TOBACCO

[75] Inventor: Anatoly I. Kramer, Winston-Salem, N.C.

[73] Assignee: R. I. Reynolds Tobacco Company, Winston-Salem, N.C.

[21] Appl. No.: 389,388

[22] Filed: Aug. 4, 1989

[51] Int. Cl.[5] ..... A24B 3/18

[52] U.S. Cl. ..... 131/291; 131/296; 131/900

[58] Field of Search ..... 131/900, 296, 291

[56] References Cited

U.S. PATENT DOCUMENTS 3,524,451 8/1970 Fredrickson .
3,683,937 8/1972 Fredrickson et al. .
3,771,533 11/1973 Armstrong et al. .
4,235,250 11/1980 Utsch .
4,258,729 3/1981 Burde et al. .
4,333,483 6/1982 Burde et al. .
4,336,814 6/1982 Sykes et al. .
4,414,987 11/1983 Utsch et al. .
4,524,452 8/1970 Moser et al. .
4,531,529 7/1985 White et al. .
4,630,619 12/1986 Korte et al. ..... 131/296
4,696,313 9/1987 Brown et al. .

*Primary Examiner*—V. Millin
*Attorney, Agent, or Firm*—Grover M. Myers

[57] ABSTRACT

The invention is directed to a process for increasing the filling capacity of tobacco wherein tobacco is contacted with a mixture of an inert, normally gaseous expansion agent and about 15–35 weight percent of carbon dioxide at a pressure above the critical pressure of the mixture and a temperature above the critical temperature of the mixture, followed by rapid release of pressure to provide expanded tobacco without a subsequent heating step. Advantageously, the expansion agent is propane.

30 Claims, 1 Drawing Sheet

METHOD OF EXPANDING TOBACCO

FIELD OF THE INVENTION

This invention relates to a process for expanding tobacco to increase its filling capacity, i.e., to reduce its bulk density. More particularly, this invention relates to a process for expanding tobacco employing a propane/-carbon dioxide mixture as the expansion agent. The process is especially suitable for treating cigarette cut filler.

BACKGROUND OF THE INVENTION

Tobacco leaves normally contain a considerable quantity of moisture when harvested. During the process of curing tobacco, the tobacco leaf loses this moisture and shrinks. Subsequent storage and treatment, such as cutting, contribute to this shrunken or collapsed condition of the entire leaf, particularly the thin lamina portion which is used for cut filler for cigarettes.

Prior to about 1970, several processes have been suggested or proposed for increasing the filling capacity of tobacco. Insofar as we are aware, none of these proposals were sufficiently practical to be put into commercial production and use. Many did not achieve enough expansion or increase in filling capacity to be economically practical; others created too many fines or otherwise damaged the fragile lamina, while others were applicable only to the easily expanded stem portion of the tobacco leaf and were not applicable to lamina, the principal ingredient of cut filler for cigarettes. Still other suggestions, such as freeze drying, required elaborate and expensive processing equipment and very substantial operating costs.

One of the first such known processes is described in U.S. Pat. No. 1,789,435 to W. J. Hawkins wherein a method and apparatus for increasing the volume of cured tobacco is described. In this process, cured and conditioned tobacco is contacted with a gas, which may be air, carbon dioxide or steam, under about 1.4 $Kg/cm^2$ pressure and then the pressure is suddenly released to expand the tobacco constituents toward their original volume. It is stated in this patent that the volume of tobacco may, by that process, be increased by about 15%.

A series of patents to Roger Z. de la Burde, U.S. Pat. Nos. 3,409,022; 3,409,023; 3,409,027 and 3,409,028 relate to various processes for enhancing the utility of tobacco stems for use in smoking products by subjecting the stems to expansion operations utilizing various types of heat treatment or microwave energy. Processes for expanding tobacco stems are not particularly relevant, however, because stems are so easily puffed.

U.S. Pat. No. 3,710,802 to William H. Johnson and British Specification No. 1,293,735 to American Brands, Inc. relate to freeze-drying methods for expanding tobacco.

None of the aforementioned processes have proved to be practical for expanding cut filler tobacco suitable for cigarettes.

In 1970, Fredrickson, U.S. Pat. No. 3,524,451 (reissued as Re. 30,693 in 1981), and Moser-Stewart, U.S. Pat. No. 3,524,452 were granted. These patents describe processes wherein tobacco is contacted with a volatile impregnant and then heated by rapidly passing a stream of hot gas in contact therewith to volatilize the impregnant and expand the tobacco. These flash-expansion processes proved to be the first commercially practical processes for increasing the filling capacity of tobacco, particularly cut filler tobacco, and have now been widely accepted and put into extensive commercial use throughout the world.

A variation of these processes is described in the subsequently issued Frederickson-Hickman, U.S. Pat. No. 3,683,397 which teaches increasing the filling capacity of tobacco by contacting it with vapors of a volatile impregnant while maintaining the temperature of the tobacco above the boiling point of the impregnant at the prevailing pressure so that the tobacco remains free of any liquid or solid form of the impregnant, and thereafter rapidly reducing the pressure or rapidly increasing the temperature to provide vapor releasing conditions and expansion of the tobacco.

Armstrong, U.S. Pat. No. 3,771,553 involves a treatment of tobacco with carbon dioxide and ammonia gases to form ammonium carbonate in situ. The ammonium carbonate is thereafter decomposed by heat to release the gases within the tobacco cells to cause expansion of the tobacco.

Utsch, U.S. Pat. Nos. 4,235,250, and Sykes et al. 4,336,814 disclose the use of a particular impregnant, carbon dioxide, as the expansion agent in processes wherein the tobacco is contacted with carbon dioxide gas or liquid to impregnate the tobacco, and thereafter the carbon dioxide-impregnated tobacco is subjected to rapid heating conditions to volatilize the carbon dioxide and thereby expand the tobacco.

U.S. Pat. Nos. 4,258,729 and 4,333,483 to de la Burde et al. disclose a process and a tobacco product, respectively. The product comprises tobacco containing gaseous carbon dioxide in an amount of at least 1 part of gaseous carbon dioxide per 100 parts of tobacco. The product expands when rapidly heated. The process provided employs carbon dioxide as an expansion agent. The tobacco is impregnated with the carbon dioxide at an elevated pressure. Thereafter pressure is released and the impregnated tobacco is subjected to rapid heating conditions to remove the carbon dioxide and thereby expand the tobacco.

U.S. Pat. No. 4,414,987 to Utsch et al. discloses a process for increasing the filling power of tobacco lamina filled without the use of exogenous impregnants by contacting the filler with a heat transfer medium so that heat is transferred rapidly and substantially uniformly from the medium to the filler for a time sufficient to stiffen and expand the filler.

U.S. Pat. No. 4,696,313 to Brown et al. discloses a method for expanding tobacco lamina comprising contacting the tobacco with an organic expansion agent, heating the thus contacted tobacco in a closed first vessel so that the temperature of the agent is above the boiling point of the agent at a lower release pressure, and rapidly venting the first vessel into a second vessel which is at the release pressure prior to venting.

As may be seen, most of the processes for increasing filling capacity of tobacco which have been used commercially require a heating step to volatilize the impregnating material, thereby expanding the cellular structure of the tobacco. The providing of additional heat to effect expansion of the tobacco is costly in energy expenditure and equipment needed.

A prior process for increasing the filling capacity of tobacco which eliminates the heating step needed theretofore to expand the tobacco is described in U.S. Pat. No. 4,531,529 to White et al., which is assigned to the same assignee as the assignee of the present invention. In this process, tobacco in either leaf, strip or filler form, is made pliable by adjusting its water content to about 10% to 16% by weight. The tobacco is then placed in a pressure vessel and an inert gas is introduced. The gas is preferably one of a group of light hydrocarbons ($C_nH_{2n+2}$) or halogenated hydrocarbons. Propane is the hydrocarbon commonly used in commercial practice. In the process of White, propane ($C_3H_8$) in gaseous form is introduced to the vessel at a temperature above its critical temperature, thereby preventing condensation of the expansion agent during subsequent pressurization of the vessel. Pressurization involves raising the pressure in the vessel to above critical pressure of the expansion agent. This pressurization step takes approximately 1 to 10 minutes and impregnation of the tobacco occurs during this period. The vessel is then rapidly depressurized to 0 gauge pressure and the tobacco expands during depressurization. No additional heating step is necessary. Propane gas is flammable, however, and is explosive at high temperatures and pressures. This presents a potentially serious and dangerous processing problem. The propane/carbon dioxide expansion process provided by this invention ameliorates this hazard.

The primary object of this invention is to provide a process for increasing the filling capacity of tobacco wherein no heating step is needed to volatilize the impregnating material for expanding the tobacco cellular structure and which employs a combustible expansion agent mixture in a safer manner.

SUMMARY OF THE INVENTION

In accordance with the present invention, a process for increasing the filling capacity of tobacco is provided which comprises contacting tobacco with an expansion agent mixture at elevated temperature and pressure conditions, then releasing the pressure to about atmospheric pressure in a relatively short time period so that the tobacco is expanded, thereby increasing its filling capacity in the absence of a subsequent separate heating step. The expansion agent mixture comprises a light hydrocarbon or a halogenated hydrocarbon as the expanding component, and carbon dioxide. The filling capacity of tobacco may generally be defined as its ability to form firm cigarette rods at a given moisture content and may be increased by, among various methods, expanding the tobacco.

The process of this invention can be applied to cured tobacco in the form of leaf (including stems and veins), strips (leaf with the stems removed), or cigarette cut filler (strips cut or shredded for cigarette making and including shredded, cured tobacco exclusive of the large stems). Tobacco in the form of cut filler is preferred because the process is more effective with the smaller particle size and some of the increase in filling capacity may be lost if expanded tobacco in the form of leaf or strip were subsequently run through a cutter or shredder.

The tobacco to be treated should be in a pliable condition to minimize breakage or shattering during handling and processing. The traditional way of making tobacco pliable is to adjust the water content to within the range of about 8 to 30 percent. Little water is lost from the tobacco during processing according to the present invention, the moisture content usually being reduced only about 1-4%. Tobacco starting with a moisture content of about 13 to 19%, e.g. 16-19%, will result in expanded tobacco of suitable moisture for cigarette making without the need for further moisture adjustment.

Expansion agents which may be used in accordance with this invention are those inert agents which impregnate the tobacco, i.e., which thoroughly permeate the cellular structure of the tobacco, and cause expansion of its cellular structure when pressure is reduced from 40 $Kg/cm^2$ and higher without formation of the solid phase of the agent and without a subsequent heating step. A preferred expansion agent is a mixture of carbon dioxide and a low-boiling highly volatile compound which has a critical temperature in the range of 30° to 155° C., preferably 32° to 120° C. The term inert as used herein refers to those agents which do not chemically react with any component of the tobacco to any appreciable degree. The preferred expansion agents include the light hydrocarbons ethane, propane, propylene, n-butane, isobutane, and the halogenated hydrocarbons (halocarbons) Refrigerent 12 (dichlorodifluoromethane) and Refrigerant 22 (monochlorodifluoromethane). Preferred hydrocarbon compounds have an atmospheric pressure boiling point in the range of about −90° to about 2° C. Mixtures of hydrocarbon compounds and carbon dioxide may be used satisfactorily. Critical values of temperature and pressure for such mixtures may be estimated with suitable accuracy using the methods described in "Chemical Engineers, Handbook", Fifth Edition, edited by Robert H. Perry and Cecil H. Chilton and published by McGraw-Hill Publishing Company, pages 3-227 et seq.

The process of the present invention is carried out by placing tobacco having a water moisture content of from about 8 to about 30 wt. % into a suitable pressure vessel and introducing an expansion agent in the vapor state in contact with the tobacco in the vessel to impregnate the tobacco with expansion agent. The expansion agent vapor is preferably introduced to the vessel at supercritical temperature, i.e., at a temperature above the critical temperature of the expansion agent, so that little or no liquid expansion agent forms in the vessel as the pressure is increased. It is preferable to maintain the temperature of the tobacco above the vapor-liquid equilibrium temperature of the expansion agent during pressurization of the vessel, although some condensation of expansion agent during this time is not harmful. Introduction of expansion agent vapor at a temperature of about 20° to 42° C. above the critical temperature of the expansion agent will, under most circumstances, prevent excessive condensation of the expansion agent during pressurization of the tobacco-containing vessel.

In the process of this invention the gaseous expansion agent is contacted with the tobacco at supercritical conditions of at least 40 $Kg/cm^2$.

Because of the time required to increase the pressure of the expansion agent to about 40 $Kg/cm^2$ and above, typically about two to 10 minutes, and because the expansion agent is introduced as a gas, little or no additional holding time under pressure is needed in order to achieve effective impregnation of the tobacco by the expansion agent. When using lower pressures, somewhat greater expansion of the tobacco can be achieved by maintaining the pressure for a brief period before initiating depressurization. Depressurization is carried out at a relatively high rate so that the pressure is reduced at or near atmospheric pressure within a short period of about one second to 10 minutes, preferably less than 1 minute, more preferably less than 10–30 seconds.

Expansion agent is expelled from the tobacco during depressurization and the tobacco is removed from the pressure vessel after the pressure is reduced to zero gauge pressure. Surprisingly, no heating step is required subsequent to pressurization either to cause expansion of the tobacco or to set or fix the tobacco in expanded condition.

Several advantages arise from the absence of a subsequent heating step. Among these is a higher quality expanded tobacco product because volatile constituents have not been driven off by heating. Other advantages include reduced handling of the tobacco with consequent breakage and lower equipment and operating costs.

DESCRIPTION OF THE PREFERRED EMBODIMENTS

Figure 1:
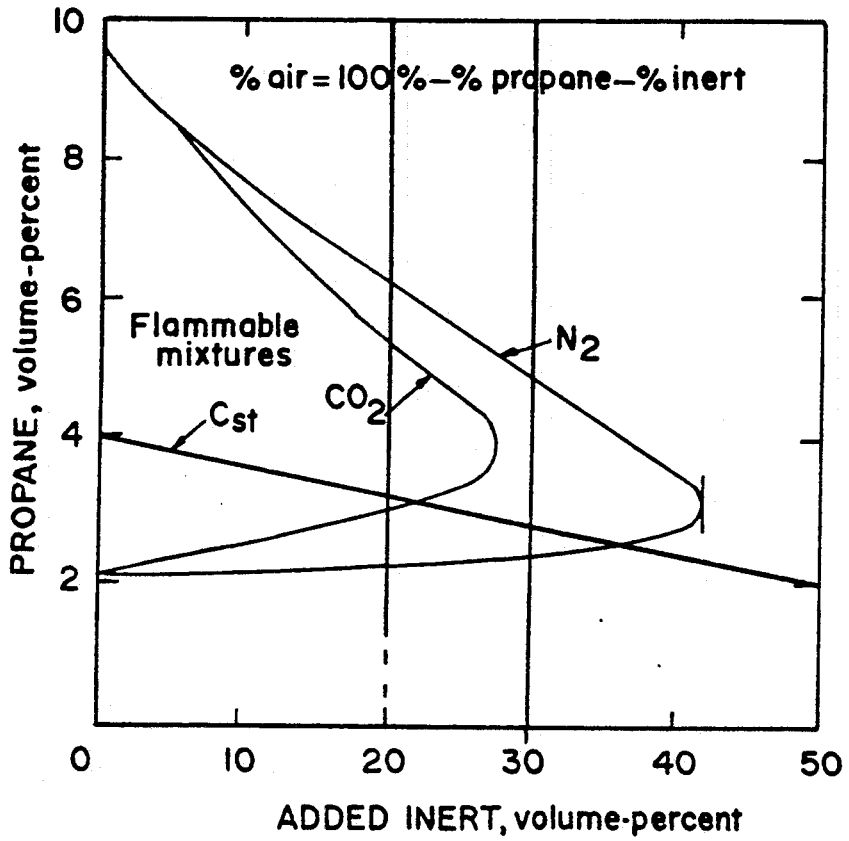
FIG. 1 is a graphic representation of a limit-of-flammability curve for a propane-inert gas mixture.

This invention relates broadly to the use of a low-boiling, highly volatile composition as the expanding component mixed with carbon dioxide to define an expansion agent mixture which is used in a process for increasing the filling capacity of tobacco. Increases in filling capacity of about 50% and more are achieved by this process without the necessity for a heating step needed by some other processes in order to set or fix the tobacco in an expanded condition. The preferred volatile components of the expansion agent are those normally gaseous hydrocarbons and halocarbons having an atmospheric pressure boiling point in the range of from −90° to 2° C. Such hydrocarbons include the saturated unbranched acyclic hyrocarbon propane. These volatile compounds have a critical temperature in the range of from 30° to 155° C. The boiling points and critical points of preferred expanding components and for carbon dioxide used in the expansion agent mixture are listed in the table below:

TABLE 1

| Compound | Boiling Point, °C. | Critical Point Temp, °C. | Critical Point Press., Kg/cm$^2$ |
|---|---|---|---|
| Ethane | −89 | 32 | 49.9 |
| Propane | −42 | 97 | 43.4 |
| Propylene | −47 | 92 | 47.1 |
| Isobutane | −12 | 135 | 37.2 |
| n-Butane | −0.5 | 152 | 38.7 |
| R-12 | −30 | 112 | 42.0 |
| R-22 | −41 | 96 | 50.7 |
| Carbon Dioxide | −78.5 | 31 | 72.8 |

Mixtures of these compounds with the carbon dioxide may also be used as expansion agents. For ease of operation, however, it is preferred to use a relatively pure volatile component in the expansion agent containing at least about 90 to 95% of one compound.

The following table reveals the limits of flammability of the preferred expanding components determined at atmospheric pressure and room temperature for upward propagation in a tube or bomb 2 inches or more in diameter. Values are on a percentage-by-volume basis.

TABLE 2

| Compound | Limits of Inflammability Lower | Limits of Inflammability Upper |
|---|---|---|
| Ethane | 3.00 | 12.50 |
| Propane | 2.12 | 9.35 |
| Propylene | 2.00 | 11.10 |
| Isobutane | 1.80 | 8.44 |

Naturally, the boiling point, critical conditions (temperature and pressure) and limits of inflammability revealed above will change when the compounds are mixed with carbon dioxide and will be further affected by the relative percentages of each compound defining the expanding component of the expansion agent.

To carry out the tobacco expansion process of the present invention, tobacco having a moisture content (OV value) in the range of about 8 to 30 wt. % (the normal moisture content of tobacco being 10–13%), preferably about 10–16 percent, and preferably about 13 to 16 percent, most preferably 16–19%, is confined within a pressure vessel provided having one or more conduits for introducing and withdrawing gases. The tobacco is placed in the vessel in such a manner whereby it can be suitably immersed or contacted by the expansion agent. Preferably, most of the air is removed from the vessel prior to introduction of expansion agent to increase safety in view of the combustible components used in the expansion agent and to reduce dilution of the expansion agent gases to be introduced into the vessel. However, the air-removal step may be eliminated without detriment to the final product. The air may be removed by purging the vessel with an inert gas, such as nitrogen or expansion agent, or by the use of a vacuum. It is possible, but not preferred, to evacuate air from the vessel to a suitable subatmospheric pressure of, for example, about 125 mm. of mercury absolute but such treatment can result in undesirable moisture changes in the tobacco.

The vessel is then pressurized while the expansion agent is being heated, in a heat exchanger connected to the vessel, to a temperature well above the critical temperature of the agent. A pressure well above the critical pressure of the agent is also maintained. These impregnation conditions are maintained for a period of time, depending upon the carbon dioxide content and the extent to which the pressure exceeds the critical pressure of the agent (higher carbon dioxide content and lower pressure requires longer impregnation times). The impregnation conditions are preferably maintained for a period of about 1 to 5 minutes.

Expansion agent is then introduced into contact with the tobacco in the vessel at supercritical temperature so that no liquid expansion agent forms in the vessel as the pressure is increased. The temperature of the expansion agent as it is introduced is in the range of between the critical temperature of the expansion agent and about 42° C. above the critical temperature. Pressurization of the tobacco within the vessel is continued until the expansion agent pressure is at least about 40 Kg/cm$^2$, preferably above about 57 Kg/cm$^2$, most desirably above about 110 Kg/cm$^2$. The temperature and pressure conditions required to prevent formation of condensed liquid expansion agent during pressurization may be ascertained easily by use of temperature pressure-enthalpy diagrams. In order to maximize the degree of tobacco expansion attained, it is preferred that the temperature of the tobacco while under expansion-agent pressure not be higher than about 42° C. above the critical temperature of the expansion agent used.

Impregnation of the tobacco with the expansion agent is normally satisfactorily complete by the time the desired pressure is reached, however, when using lower pressures in the range of 36 to 57 Kg/cm$^2$, it may be advantageous to maintain the pressure for about 2 to 10 minutes prior to initiation of depressurization.

Pressure within the vessel is then reduced to about atmospheric pressure within a period of about 1 second to 10 minutes, preferably within a time period of 3 to 300 seconds, and most desirably within about 15 seconds. The rate of release of the impregnant is controlled so that the initial stage of depressurization is at nearly constant enthalpy. This results in a portion of the propane impregnant condensing in or on the tobacco for a very short time. The vessel is then opened and expanded tobacco is recovered from it. No additional heating step subsequent to depressurization is needed to set or fix the tobacco in its expanded condition. The expanded tobacco can easily be adjusted to ambient temperature by conventional means. The expansion agent gases vented from the vessel during the depressurization step may be recovered by conventional means, if desired. Tobacco can be expanded by this process to a satisfactory extent without excessive fracturing by using pressures below 142 Kg/cm$^2$, so higher pressures usually are not needed.

The process provided by this invention achieves results not contemplated by prior art. For example, an expansion of 60% to 70% can be obtained with carbon dioxide content as high as 32% to 34%. With carbon dioxide content at 30%, about 95% expansion can be obtained. When carbon dioxide content is dropped to 20%, more than 100% expansion can be obtained.

While the phenomenon by which tobacco expansion occurs is not fully understood, it is believed that most effective expansion of tobacco is achieved when at least a portion of the expansion agent is transformed to the liquid or condensed phase in the tobacco during depressurization and subsequently vaporizes as the pressure within the vessel is further reduced. It is not known at what precise point during the process expansion occurs, but it is believed to occur during the depressurization. When the pressure vessel is opened for recovery of the tobacco after depressurization is complete, it is unexpectedly found in an expanded condition without considerable damage to the cellular structure, its filling capacity having been increased by 50% or more. Filling capacity increases of over 100% and even up to 150% and more have been achieved by use of the process provided by this invention.

The expansion process involves mixing of the volatile expanding component with carbon dioxide. In practice, propane is commonly preferred as the expanding component. In this regard, mixtures of propane and carbon dioxide containing from about 17% to 35% carbon dioxide are employed in the process provided by this invention. A mixture of propane and carbon dioxide (liquid or gas) has a diminishing propensity to flame and explode as the percentage of carbon dioxide increases. Moreover, carbon dioxide has the advantages of being neither flammable nor toxic, not maintaining combustion, and also not exerting a corrosive effect in combination with the moisture on the materials used in the expansion process (stainless steel or plastics). Carbon dioxide is also inexpensive and readily available in large quantities and high purity.

Using a propane-carbon dioxide mixture as the expansion agent in the process of this invention produces a desirable product. Propane does not undesirably contaminate the tobacco because propane is a natural combustion product of burning tobacco. Propane is not "natural to tobacco", per se, however, as propane is not a naturally occurring component of the tobacco itself. Likewise, carbon dioxide does not contaminate tobacco.

Furthermore, the propane-carbon dioxide mixture is substantially removed from the tobacco during depressurization so as to avoid affecting aroma and other properties of the smoke. A higher quality expanded tobacco product is produced because post-depressurization heating is avoided (volatile constituents are not driven off).

The amount of propane and carbon dioxide in the final product, the puffed tobacco, is difficult to measure accurately as each compound dissipates rapidly. In theory, however, less than 1% propane and far less than 1% carbon dioxide are present in the expanded tobacco at any time after decompression.

As noted above, whereas propane along expands tobacco satisfactorily with impregnation times of less than 1 minute, the addition of carbon dioxide to the impregnating expansion agent requires increased impregnation times of up to 5 minutes, depending upon the amount of carbon dioxide being used. When the carbon dioxide level reaches 35%, the amount of tobacco "puffing" decreases to the extent that it is not acceptable without post-decompression heating. Accordingly, slightly less than about 32% to 34% has been found to be the practical limit of carbon dioxide content using the invention process.

Control tests have also been conducted to determine to what extent the carbon dioxide is contributing to the expansion process. Employing different supercritical temperatures and pressures, and no post-decompression heating of the tobacco, the expansion achieved using only carbon dioxide as the impregnant was measured. The maximum expansion obtained was about 10% to 15%.

The propane-carbon dioxide mixture has numerous advantages over alternative substances for reducing the hazards created by working with propane. Carbon dioxide is miscible with propane in liquid form so it can be obtained already mixed. Mixtures of propane with carbon dioxide are also less flammable than with nitrogen or helium alternatives, while not inhibiting expansion capability as much. Furthermore, a lower propane content (in total) in the large quantities of tobacco treated is an added safety factor after puffing, and the overall quality of the product is equal to that produced using only propane. In this regard, the use of propane-carbon dioxide mixtures results in the necessity of using slightly higher tobacco moisture contents initially, as well as varying other parameters, such as temperatures and impregnation times.

The limits of flammability of some flammable hydrocarbons in carbon dioxide and oxygen, as well as in mixtures of air and various inerts are known as shown in FIG. 1. FIG. 1 presents graphically the known limit-of-flammability curves of propane-carbon dioxide air and propane-nitrogen-air mixtures at 25° C. and atmospheric pressure. This information is useful in the present process provided by this invention as any leak of the impregnating expansion mixture would naturally bring the combustible propane in contact with the atmosphere (air). The composition of a point on FIG. 1 cannot be read directly, except one representing only propane, the combustible, and air. Instead, one must determine the composition of the atmosphere, and then compute the total mixture composition. Compositions are determined directly from the abscissas (inert gas concentration) and ordinates (combustible propane concentration); the air in any mixture is the difference between 100 percent and the sum of the inert gas (carbon dioxide or nitrogen) and the combustible propane. Inspection of the curve of FIG. 1 reveals that the minimum amounts of carbon dioxide for total flame extinction (peak values) at 25° C. and atmospheric pressure is about 28 volume-percent.

Tobacco moisture content as used herein is expressed as the percent reduction in tobacco weight upon heating in a convection oven for 5 minutes at 92° C. Filling capacity measurements of expanded and untreated tobacco samples were performed using a specially designed and electronically automated filling capacity meter in which a solid piston of about 3.625 inches in diameter that is slidably positioned in the cylinder exerts pressure of 26 psi on tobacco samples located in this cylinder. These parameters simulate the packing conditions to which tobacco is subjected on cigarette making machine during the formation of cigarette rod. The moisture content of tobacco affects the filling values determined by this method. Therefore, all expanded and not treated tobacco samples were subjected for moisture determination.

These results were taken into account for calculating corrected filling capacities of tobacco samples through previously obtained correlation tables. Measured tobacco samples were as follows: 100 g for nontreated tobacco and 50 g for expanded tobacco.

The percent increase in filling capacity, or percent expansion, was computed by subtracting the filling capacity of the unexpanded control sample from the filling capacity of the expanded sample, dividing this difference by the filling capacity of the control sample and multiplying this quotient by 100.

For a more complete understanding of this invention, reference will now be made to the following examples of procedures of practicing the process provided by this invention.

Thus, the invention provides the method of expanding tobacco as disclosed above. It must be understood, however, that there are other embodiments and variations of the process invention which may be developed and that the invention is not limited to the preferred embodiments and best mode of operation currently understood, but is only to be limited by the scope of the following claims.

EXAMPLE 1

Tobacco expansion experiments were conducted using a cylindrical tubular shell with reciprocal spool assembly prototype apparatus generally as described in U.S. Pat. No. 4,554,932 to Conrad et al. The apparatus included a pressure vessel having a volume of 4.5 liters and being capable of containing pressures up to 136 atmospheres. A thermocouple was installed inside the vessel to measure the temperature of vessel contents and a pressure gauge indicated the pressure in the vessel. Expansion agent was introduced into the vessel through a heater and a tubing coil immersed in a liquid bath. Expansion vapor was vented from the vessel using a tubing line provided with a throttle valve.

A number of samples of tobacco, each weighing 180 to 220 grams were prepared. The tobacco samples consisted of a blend of burley and flue-cured tobacco lamina. Moisture of the samples was measured and recorded as set forth below. The samples were then impregnated with a mixture of carbon dioxide and propane, wherein the carbon dioxide content, by weight, is as set forth below. The samples were then treated under the conditions set forth below; for the time periods set forth below; and the pressure rapidly vented over a period of about 15 to 50 seconds through the throttle valve. The treated tobacco was recovered and tested to determine percent expansion. Results are set forth below.

| % $CO_2$ by weight in mixture | Tobacco Mois. % | Chamber Press. Kg/cm$^2$ | Chamber Temp. °C. | Impreg Time Min-Sec | % Expansion |
|---|---|---|---|---|---|
| 17.5 | 16.7 | 115.6 | 87.2 | 3-10 | 135 |
| 17.5 | 19.0 | 115.6 | 95.6 | 3-00 | 165 |
| 17.5 | 18.0 | 116.0 | 83.3 | 2-00 | 104 |
| 20.0 | 18.0 | 115.6 | 105.6 | 5-00 | 103 |
| 30.0 | 19.0 | 115.6 | 114.4 | 5-00 | 104 |
| 30.0 | 19.0 | 115.6 | 120.6 | 5-00 | 89 |
| 30.0 | 19.0 | 115.6 | 118.3 | 5-00 | 96 |
| 31.0 | 19.0 | 115.6 | 113.9 | 5-00 | 69 |
| 35.0 | 19.0 | 68.0 | 101.1 | 5-00 | 63 |
| 35.0 | 19.0 | 95.2 | 104.4 | 5-00 | 46 |

EXAMPLE 2

In this set of experiments, tobacco was treated in the same apparatus as in Example 1 but using only pure $CO_2$ as the expansion agent and at the temperatures, pressures and impregnation times set forth below. As can be seen, carbon dioxide alone contributes substantially no expansion without postheating.

| Tobacco Mois. % | Chamber Press. Kg/cm$^2$ | Chamber Temp. °C. | Impreg Time Min-Sec | % Expansion |
|---|---|---|---|---|
| 19.0 | 13.6 | 86.7 | 5-00 | 11 |
| 19.0 | 20.4 | 89.4 | 5-00 | 13 |
| 19.0 | 27.2 | 92.2 | 5-00 | 10 |
| 19.0 | 32.0 | 90.6 | 5-00 | 10 |
| 19.0 | 40.8 | 82.8 | 5-00 | 11 |
| 20.5 | 47.6 | 85.5 | 5-00 | 7 |
| 20.5 | 54.4 | 91.7 | 5-00 | 7 |
| 19.0 | 115.6 | 89.4 | 5-00 | 13 |

The invention has been described in considerable detail with specific reference to various preferred embodiments. It will be recognizes, however, that various changes may be made within the spirit and scope of the invention as described in the foregoing specification and defined in the following claims.

I claim:

1. A process for increasing the filling capacity of tobacco comprising the steps of:

contacting tobacco with a mixture of an inert, normally gaseous expansion agent having an atmospheric pressure boiling point in the range of from about −90° C. to about 2° C., and about 15–35 weight percent carbon dioxide at a pressure, above the critical pressure of said mixture and at a temperature in the range of from about the critical temperature of said mixture to about 65° C. above the critical temperature of the mixture, for a time of at least about 1 minute;

subsequently releasing the pressure to a substantially atmospheric level to thereby expand the tobacco and recovering the expanded tobacco.

2. The process as in claim 1 wherein said mixture contains carbon dioxide in an amount of about 25 to about 33 weight percent.

3. The process as in claim 1 wherein said contacting is effected at a temperature in the range of from the critical temperature of said mixture to about 42° C. above said critical temperature.

4. The process as in claim 1 wherein said contacting is effected at a pressure above about 57 Kg/cm$^2$.

5. The process as in claim 1 wherein said expansion agent is selected from the class consisting of hydrocarbons and halocarbons having an atmospheric pressure boiling point in the range of −90° to 2° C.

6. The process as in claim 1 wherein the filling capacity of said tobacco is increased at least 70% when said mixture contains carbon dioxide in the amount of about 32% to about 34%.

7. The process as in claim 1 wherein the filling capacity of said tobacco is increased at least 95% when said mixture contains carbon dioxide in the amount of about 30%.

8. The process as in claim 1 wherein the filling capacity of said tobacco is increased at least 100% when said mixture contains carbon dioxide in the amount of about 20%.

9. The process as in claim 1 wherein said mixture is in vapor form and said tobacco is impregnated by said mixture at supercritical conditions of pressure and temperature for said mixture, and wherein said depressurization causes said expansion mixture to be expelled from the tobacco and to expand the cellular structure of the tobacco during expulsion without subjecting the tobacco to additional heat.

10. The process of claim 1 wherein said contacting step is conducted for a time of less than about 10 minutes.

11. The process as in claim 1 wherein said inert gaseous expansion agent is selected from a group comprising ethane, propane, propylene, Refrigerent 12, Refrigerent 22, isobutane, n-butane, and mixtures thereof.

12. The process as in claim 1 wherein said tobacco is cigarette cut filler tobacco and wherein said contacting step includes the steps of:

placing the tobacco in a pressure vessel;

introducing the impregnating gaseous mixture into said pressure vessel in contact with the tobacco, the inert gaseous expansion agent of said mixture being highly volatile and having a low boiling point and a critical temperature between 32° C. and 120° C.; and increasing the pressure within the vessel to above the critical pressure of the mixture to thoroughly permeate the cellular structure of the tobacco with said mixture.

13. The process as in claim 12 wherein said depressurization causes the mixture to change from its highly dense state to an expanded vapor state, thereby expanding the cellular structure of the tobacco as the mixture is expelled therefrom.

14. The process as in claim 1 wherein the expansion agent is a material which has a critical temperature within the range of about 32° C. to 120° C.

15. The process as in claim 14 wherein the expansion agent is a light hydrocarbon, a halogenated hydrocarbon or a mixture thereof.

16. The process as in claim 1 wherein the expansion is effected without an additional heating step.

17. The process as in claim 1 wherein the expansion agent is a material having an atmospheric boiling point of about −90° to about 2° C.

18. The process as in claim 1 wherein the pressure at which the tobacco is contacted with the expansion agent is below about 142 Kg/cm$^2$.

19. A process for increasing the filling capacity of tobacco which comprises the following steps:

contacting the tobacco for at least about 1 minute with a mixture of an inert normally gaseous expansion component having a boiling point from about −90° C. to about 2° C. and at least about 15 weight percent carbon dioxide at a pressure of at least 36 Kg/cm$^2$ and at a temperature in the range of from the critical temperature to about 42° C. above the critical temperature of said mixture; and subsequently expelling said mixture from the tobacco by rapidly releasing the pressure to expand the cellular structure of the tobacco.

20. The process as in claim 19 wherein said contacting is effected at a pressure of at least about 57 Kg/cm$^2$.

21. The process as in claim 19 wherein said contacting is effected at a pressure above about 70 Kg/cm$^2$.

22. The process as in claim 19 wherein said contacting step includes the steps of:

contacting the tobacco with said mixture having a critical temperature in the range of from 30° C. to 155° C., said tobacco having a moisture content in the range of 10% to 30% by weight.

23. The process as in claim 19 wherein said inert gaseous expansion agent of said mixture is selected from the group comprising of hydrocarbons and halocarbons having a critical temperature in the range of from 30° C. to 155° C., and said depressurization causes at least a portion of said mixture to transfer to the liquid phase and condense in the tobacco and the continuous depressurization to an ambient level causes the mixture to be vaporized and separated from the tobacco and the tobacco to be expanded.

24. The process as in claim 19 wherein said mixture contains carbon dioxide in an amount of about 25 to about 33 weight percent.

25. The process as in claim 20 wherein said expansion agent is selected from the group consisting of ethane, propane, propylene, dichlorodifluoromethane, monochlorodifluoromethane, isobutane, n-butane, and mixtures thereof, and impregnation occurs at a pressure above about 4.5 Kg/cm$^2$ below the critical pressure of said mixture to impregnate the tobacco.

26. A process for expanding tobacco comprising the steps of:

placing tobacco within a pressure vessel;

introducing a mixture of an inert gaseous expansion agent and carbon dioxide into said pressure vessel in an amount sufficient to increase the pressure within the vessel to above about 70 Kg/cm$^2$ while maintaining the mixture substantially in the vapor phase;

maintaining a supercritical environment for said mixture within said vessel to allow said mixture to impregnate the tobacco during a time period of at least one minute; and rapidly releasing the mixture from within the vessel thereby expanding the tobacco without adding post-decompression heat, said expansion agent being selected from the class consisting of hydrocarbons and halogenated hydrocarbons having a critical temperature in the range of from 30° C. to 155° C., said carbon dioxide being present in said mixture in an amount of about 20 to about 35 weight percent.

27. The process as in claim 26 wherein said expansion agent is selected from the group consisting of ethane, propane, propylene, Refrigerent 12, Refrigerent 22, isobutane, n-butane, or mixtures thereof.

28. The process as in claim 26 wherein said supercritical pressure and temperature conditions for said mixture are maintained for a time period of from about one minute to about five minutes.

29. Tobacco treated in accordance with the expansion process of claim 26.

30. The process as in claim 26 wherein less than 1% by weight of expansion agent and less than 1% carbon dioxide are present in the tobacco after depressurization.

* * * * *